US010870549B2

(12) United States Patent
Kawashima

(10) Patent No.: US 10,870,549 B2
(45) Date of Patent: Dec. 22, 2020

(54) CONVEYING DEVICE AND IMAGE FORMING APPARATUS

(71) Applicant: KYOCERA Document Solutions Inc., Osaka (JP)

(72) Inventor: Tetsuro Kawashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 55 days.

(21) Appl. No.: 16/294,378

(22) Filed: Mar. 6, 2019

(65) Prior Publication Data

US 2019/0276255 A1 Sep. 12, 2019

(30) Foreign Application Priority Data

Mar. 9, 2018 (JP) ..... 2018-042869

(51) Int. Cl.

| | |
|---|---|
| ***B65H 5/38*** | (2006.01) |
| ***B65H 5/36*** | (2006.01) |
| ***B65H 37/00*** | (2006.01) |
| ***B65H 5/06*** | (2006.01) |

(52) U.S. Cl.

CPC ..... *B65H 5/38* (2013.01); *B65H 5/062* (2013.01); *B65H 5/36* (2013.01); *B65H 37/00* (2013.01); *B65H 2801/27* (2013.01)

(58) Field of Classification Search

None

See application file for complete search history.

(56) References Cited

U.S. PATENT DOCUMENTS

| | | | | |
|---|---|---|---|---|
| 2008/0018040 | A1* | 1/2008 | Tamura | B65H 29/12 271/3.14 |
| 2019/0071271 | A1* | 3/2019 | Furukawa | B65H 9/004 |
| 2019/0218049 | A1* | 7/2019 | Lo | B41J 11/007 |

FOREIGN PATENT DOCUMENTS

| | | |
|---|---|---|
| JP | S61-279869 A | 12/1986 |

* cited by examiner

*Primary Examiner* — Prasad V Gokhale

(74) *Attorney, Agent, or Firm* — Studebaker & Brackett PC

(57) ABSTRACT

A conveying device includes a first guide section, a second guide section, and an urging section. The second guide section has a guide center portion and pivots about the guide center portion. The second guide section is pivotable between a guide position and a separation position. The guide position is a position in which the second guide section is located when a conveyance path of a sheet is formed between the second guide section and the first guide section. When the second guide section is in the guide position, the urging section urges the second guide section in a first pivot direction.

10 Claims, 6 Drawing Sheets

CONVEYING DEVICE AND IMAGE FORMING APPARATUS

INCORPORATION BY REFERENCE

The present application claims priority under 35 U.S.C. § 119 to Japanese Patent Application No. 2018-042869, filed on Mar. 9, 2018. The contents of this application are incorporated herein by reference in their entirety.

BACKGROUND

The present disclosure relates to a conveying device and an image forming apparatus.

In an image forming apparatus, part of a device located in an upper part of a main body of the apparatus can be fully opened. As the part of the device opens, a conveyance path in an inversion section is exposed. In the above configuration, a jammed sheet in the conveyance path can be removed.

SUMMARY

A conveying device according to an aspect of the present disclosure conveys a sheet. The conveying device includes a first guide section, a second guide section, and an urging section. The first guide section extends in a conveyance direction of the sheet. The second guide section has a guide center portion and pivots about the guide center portion. The urging section is configured to urge the second guide section. The second guide section is pivotable between a guide position and a separation position. The guide position is a position in which the second guide section is located when a conveyance path of the sheet is formed between the second guide section and the first guide section. The separation position is a position in which the second guide section is located as a result of pivoting from the guide position by a specific angle. When the second guide section is in the guide position, the urging section urges the second guide section in a first pivot direction in which the second guide section pivots from the separation position toward the guide position.

An image forming apparatus according to another aspect of the present disclosure includes the conveying device according to the above aspect.

DETAILED DESCRIPTION

Figure 1:
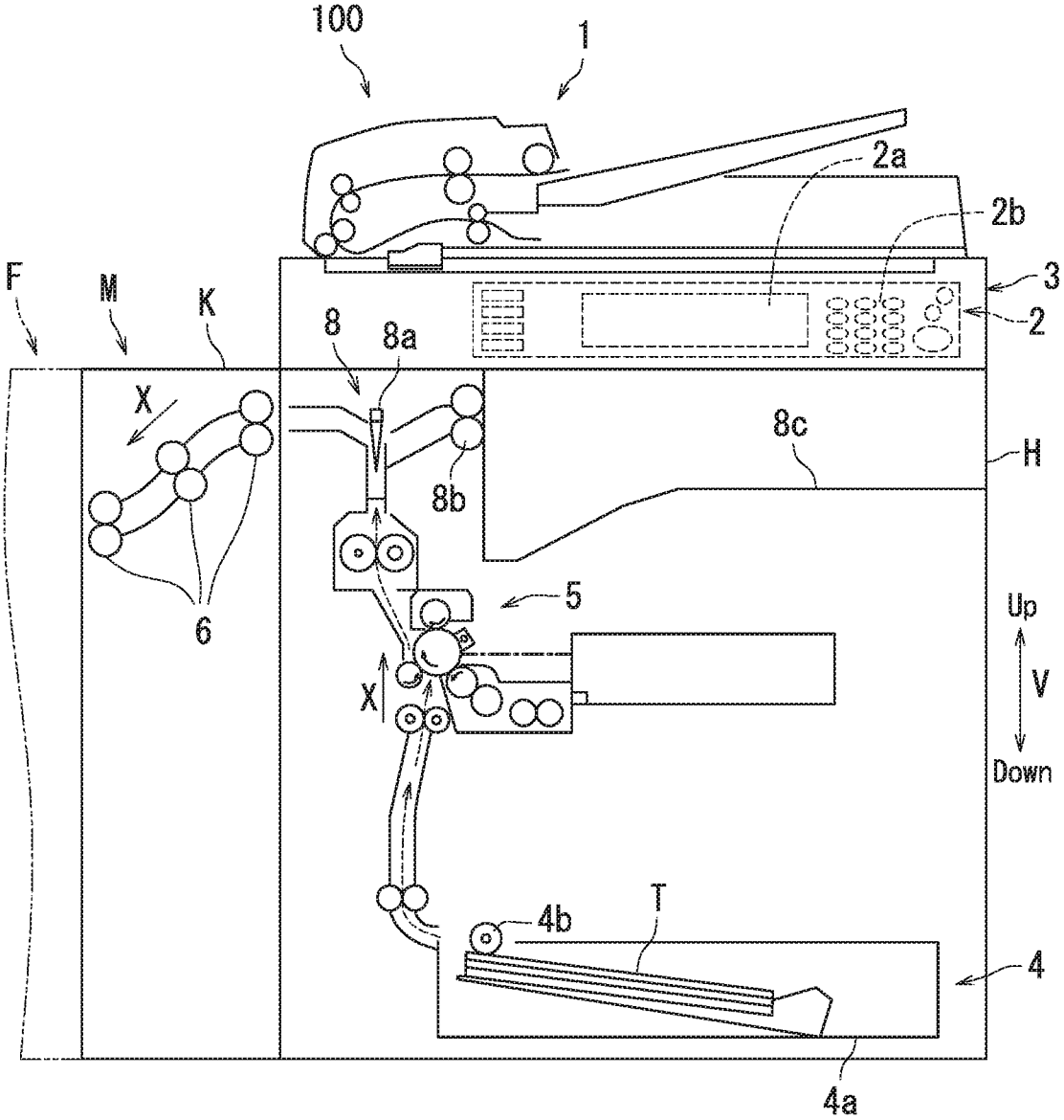
FIG. 1 is a schematic cross-sectional view of an image forming apparatus according to an embodiment of the present disclosure.

The following describes an embodiment of the present disclosure with reference to the accompanying drawings. Note that elements that are the same or equivalent are labelled with the same reference signs in the drawings, and description of those elements will not be repeated.

The following describes an image forming apparatus 100 according to the embodiment of the present disclosure with reference to FIG. 1. FIG. 1 is a schematic cross-sectional view of the image forming apparatus 100.

As illustrated in FIG. 1, the image forming apparatus 100 includes a conveyance section 1, an input section 2, a reader 3, a sheet feeding section 4, an image forming section 5, an ejection section 8, and a housing H.

The conveyance section 1 conveys a document toward the reader 3. The reader 3 acquires image data by scanning an image on the document. The reader 3 for example includes light emitting elements such as light emitting diodes (LEDs) and an image capturing section such as an image sensor. The reader 3 scans the image on the document using the light emitting elements and the image capturing section. Examples of the document include plain paper, copy paper, recycled paper, thin paper, thick paper, glossy paper, and an overhead projector (OHP) sheet.

The input section 2 includes a display section 2*a* and an operation key set 2*b*. The input section 2 receives an instruction from a user to the image forming apparatus 100. The display section 2*a* functions as a touch panel, for example.

The sheet feeding section 4 includes a cassette 4*a* and a pickup roller 4*b*. The cassette 4*a* accommodates sheets T. The pickup roller 4*b* feeds the sheets T accommodated in the cassette 4*a* to the outside of the cassette 4*a* on a sheet-by-sheet basis. Examples of the sheets include plain paper, copy paper, recycled paper, thin paper, thick paper, glossy paper, and an overhead projector (OHP) sheet.

The image forming section 5 forms an image on a sheet T. The image is a toner image in the present embodiment. The image forming section 5 includes a photosensitive drum, a charger, a light exposure section, a development section, a transfer section, a cleaner, a static eliminator, and a fixing device. The image is formed on the sheet T through use of the photosensitive drum, the charger, the light exposure section, the development section, and the transfer section. The cleaner removes toner remaining on a surface of the photosensitive drum. The static eliminator removes residual charge from the surface of the photosensitive drum. After the image is formed on the sheet T, the image forming section 5 feeds the sheet T toward the fixing device. The fixing device fixes the image to the sheet T through application of heat and pressure to the image.

The ejection section 8 ejects the sheet T with the image formed thereon by the image forming section 5 out of the housing H. The ejection section 8 includes a diverging guide 8*a*, an ejection roller 8*b*, and an exit tray 8*c*. The diverging guide 8*a* can be switched between a first posture and a second posture. When the diverging guide 8*a* is in the first posture, the diverging guide 8*a* guides the sheet T toward the exit tray 8*c*. When the diverging guide 8*a* is in the second posture, the diverging guide 8*a* guides the sheet T toward a conveying device M described below.

The housing H houses the sheet feeding section 4, the image forming section 5, and the ejection section 8.

The image forming apparatus 100 further includes the conveying device M located opposite to a side surface of the housing H. The conveying device M conveys the sheet T with the image formed thereon by the image forming section 5 to a post-processing device F located adjacent to the conveying device M. The conveying device M is located upstream of the post-processing device F in a conveyance direction X of the sheet T and downstream of the ejection section 8 of the image forming apparatus 100 in the conveyance direction X of the sheet T. The post-processing device F performs specific post processing on the sheet T. The specific post processing is for example either or both of punching processing and stapling processing. The punching processing is processing of forming a punch hole in the sheet. The stapling processing is processing of binding a sheaf of sheets with a binding tool such as a staple.

Figure 2:
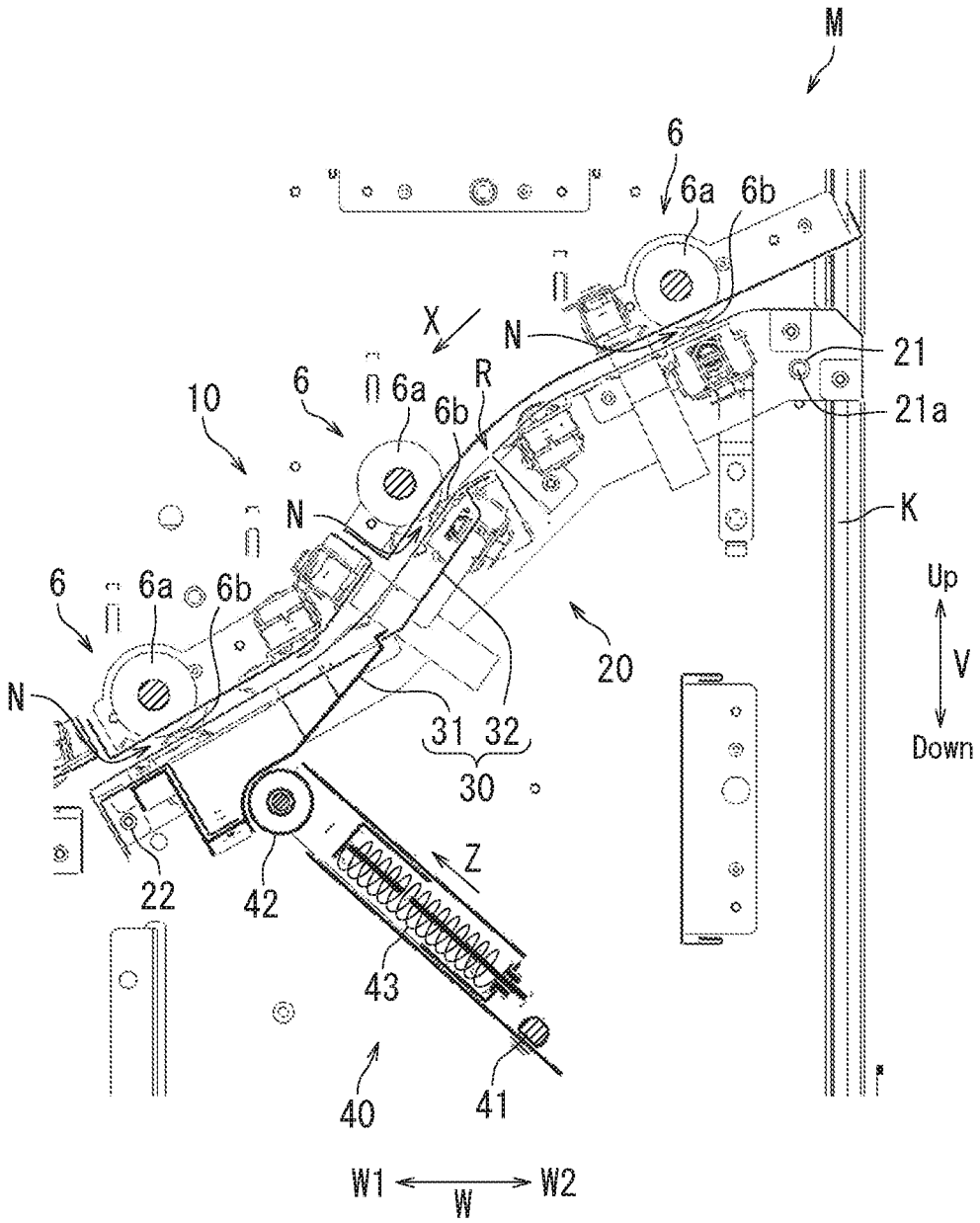
FIG. 2 is a schematic cross-sectional view of a conveying device.

The following describes the conveying device M with reference to FIG. 2. FIG. 2 is a schematic cross-sectional view of the conveying device M.

As illustrated in FIG. 2, the conveying device M includes a frame K, a first guide section 10, a second guide section 20, and three conveyance roller pairs 6. The first guide section 10, the second guide section 20, and the conveyance roller pairs 6 are located within the frame K. The first guide section 10 and the second guide section 20 form a conveyance path R of the sheet T. Each of the conveyance roller pairs 6 includes a first roller 6*a* and a second roller 6*b*. The first roller 6*a* and the second roller 6*b* are in contact with each other to form a nip part N therebetween. The conveyance roller pairs 6 convey the sheet T through the first rollers 6*a* and the second rollers 6*b* rotating while holding the sheet T at the nip parts N.

The first guide section 10 extends in the conveyance direction X of the sheet T. The first guide section 10 is made from a resin, for example. The first guide section 10 is secured to the frame K, for example. The first rollers 6*a* are rotatably attached to the first guide section 10.

The second guide section 20 extends in the conveyance direction X of the sheet T. The second guide section 20 is made from a resin, for example. The second guide section 20 is pivotably supported. The second guide section 20 is for example attached to the frame K and pivotably supported by the frame K. The second guide section 20 is located lower than the first guide section 10 in a vertical direction V. The second rollers 6*b* are rotatably attached to the second guide section 20.

The second guide section 20 has a guide center portion 21 and a pivotable end 22.

A first pin 21*a* is inserted through the guide center portion 21, for example. The first pin 21*a* is attached to the frame K. Accordingly, the guide center portion 21 is turnably attached to the frame K by means of the first pin 21*a*. In this configuration, the second guide section 20 pivots about the guide center portion 21.

The pivotable end 22 is located lower than the guide center portion 21 in the vertical direction V. The pivotable end 22 pivots about the guide center portion 21.

The conveying device M further includes a rail section 30. The rail section 30 is provided along the second guide section 20. The rail section 30 pivots together with the second guide section 20. The rail section 30 has a shape extending along the second guide section 20. The rail section 30 includes a first rail 31 and a second rail 32. The first rail 31 is connected to the second rail 32. The first rail 31 and the second rail 32 together form a shape substantially extending in a straight line. The first rail 31 is located farther from the guide center portion 21 than the second rail 32. The first rail 31 is located close to the pivotable end 22.

The conveying device M further includes an arm section 40.

Figure 3:
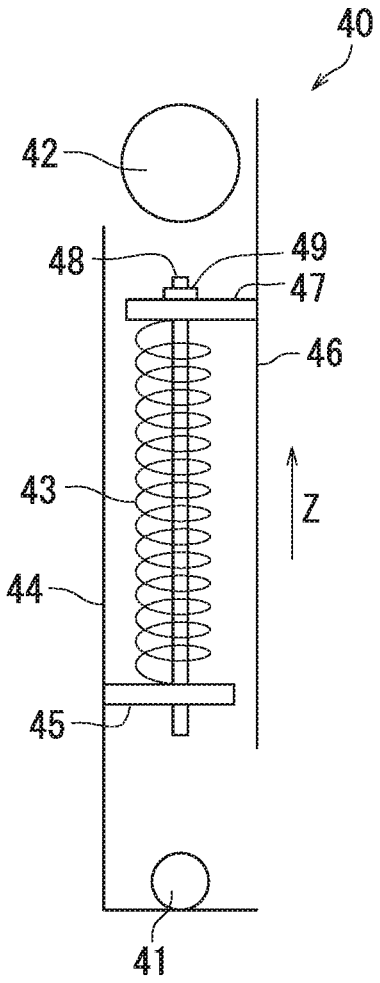
FIG. 3 is a schematic cross-sectional view of an arm section.

The following describes the arm section 40 with reference to FIGS. 2 and 3. FIG. 3 is a schematic cross-sectional view of the arm section 40.

As illustrated in FIG. 2, the arm section 40 is pivotably supported. The arm section 40 is for example attached to the frame K and pivotably supported by the frame K. The arm section 40 includes an arm center portion 41, a movable section 42, and an urging section 43.

A non-illustrated second pin is inserted through the arm center portion 41, for example. The second pin is attached to the frame K. Accordingly, the arm center portion 41 is turnably attached to the frame K by means of the second pin. In this configuration, the arm section 40 pivots about the arm center portion 41.

The arm center portion 41 is located lower than the guide center portion 21 in the vertical direction V. Also, the arm center portion 41 is located on one side W1 in a horizontal direction W as seen from the guide center portion 21.

The movable section 42 is movable on the rail section 30. The movable section 42 is located upper than the arm center portion 41 in the vertical direction V.

The movable section 42 is turnably supported and rolls on the rail section 30 in the present embodiment. Note that the movable section 42 may slide on the rail section 30 rather than rolling. The movable section 42 is attached to the arm center portion 41 via the urging section 43.

The urging section 43 is capable of urging the second guide section 20. The urging section 43 is elastically deformable. The urging section 43 is for example a spring. The urging section 43 is located between the arm center portion 41 and the movable section 42. The urging section 43 and the movable section 42 pivot together about the arm center portion 41.

As illustrated in FIG. 3, the arm section 40 further includes a first support 44, a first sandwich member 45, a second support 46, a second sandwich member 47, a slidable member 48, and a retaining member 49.

The arm center portion 41 is secured to the first support 44. The first sandwich member 45 is secured to the first support 44. The movable section 42 is attached to the second support 46. The movable section 42 is turnably attached to the second support 46 in the present embodiment. The second sandwich member 47 is secured to the second support 46. The second sandwich member 47 is spaced from the first sandwich member 45 in a separation direction Z. The separation direction Z is a direction in which the movable section 42 moves away from the arm center portion 41. In other words, the separation direction Z is a direction from the arm center portion 41 toward the movable section 42.

The slidable member 48 extends in the separation direction Z. The slidable member 48 is secured to the first sandwich member 45. The slidable member 48 is attached to the second sandwich member 47 to be slidable in the separation direction Z relative to the second sandwich member 47. For example, a hole extending in the separation direction Z is formed through the second sandwich member 47, and the slidable member 48 is inserted in the hole of the second sandwich member 47. The retaining member 49 is secured to the slidable member 48. The retaining member 49 has a larger dimension than the hole of the second sandwich member 47. The retaining member 49 prevents the slidable member 48 from falling off from the hole of the second sandwich member 47.

Note that the slidable member 48 may be secured to the second sandwich member 47 and attached to the first sandwich member 45 to be slidable in the separation direction Z relative to the first sandwich member 45.

The urging section 43 is located between the first sandwich member 45 and the second sandwich member 47. The slidable member 48 is inserted through the urging section 43. The urging section 43 elastically deforms in the separation direction Z. In this configuration, the movable section 42 is supported to be movable in the separation direction Z.

When the movable section 42 comes close to the arm center portion 41 by moving in a direction opposite to the separation direction Z, the arm section 40 contracts. When the arm section 40 contracts, the urging section 43 contracts between the first sandwich member 45 and the second sandwich member 47. When the urging section 43 contracts, an elastic force in the separation direction Z is generated in the urging section 43. As a result, the urging section 43 urges the movable section 42 in the separation direction Z.

When the movable section 42 is located on the rail section 30, the urging section 43 urges the movable section 42 in the separation direction Z as illustrated in FIGS. 2 and 3.

Figure 4:
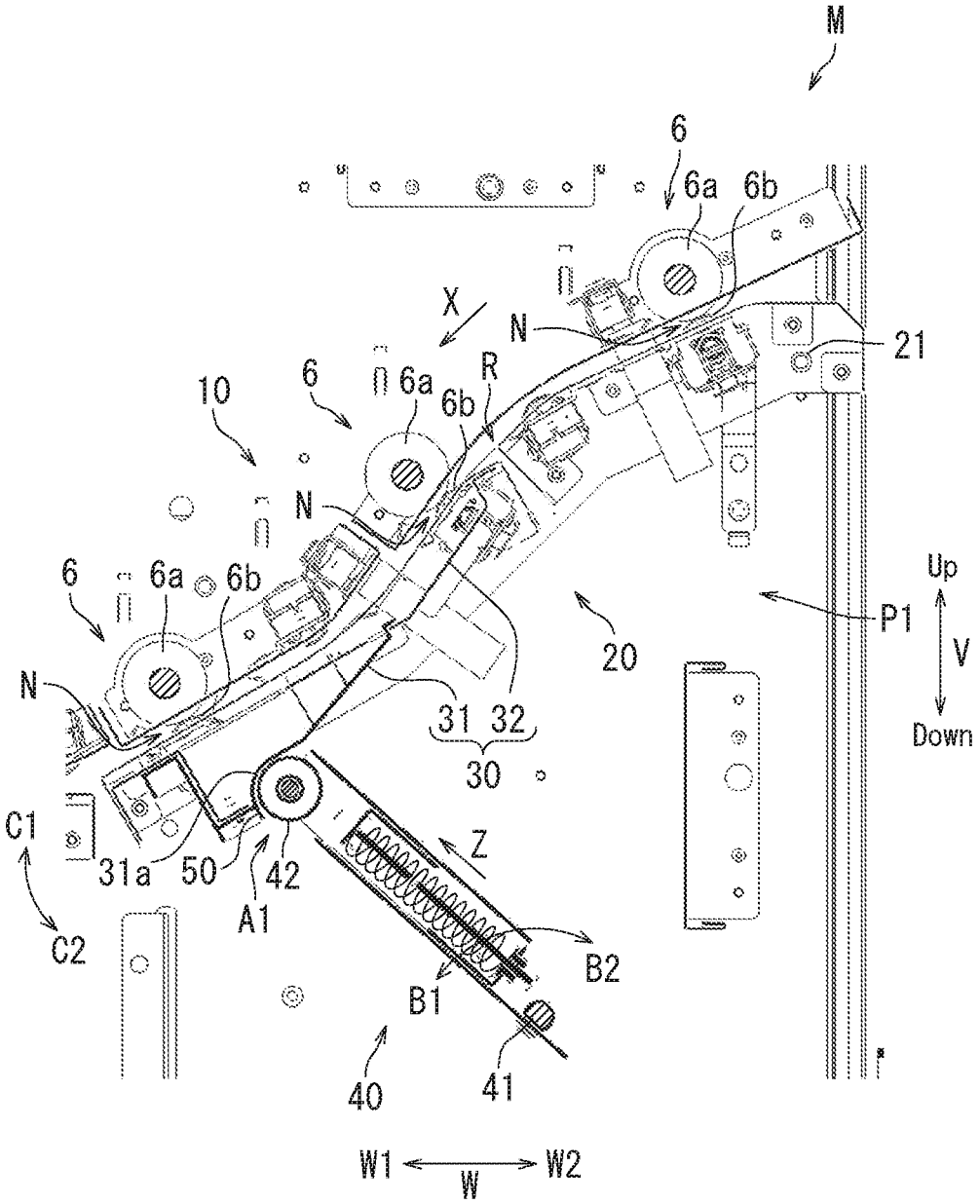
FIG. 4 is a schematic cross-sectional view illustrating a second guide section in a guide position.
Figure 5:
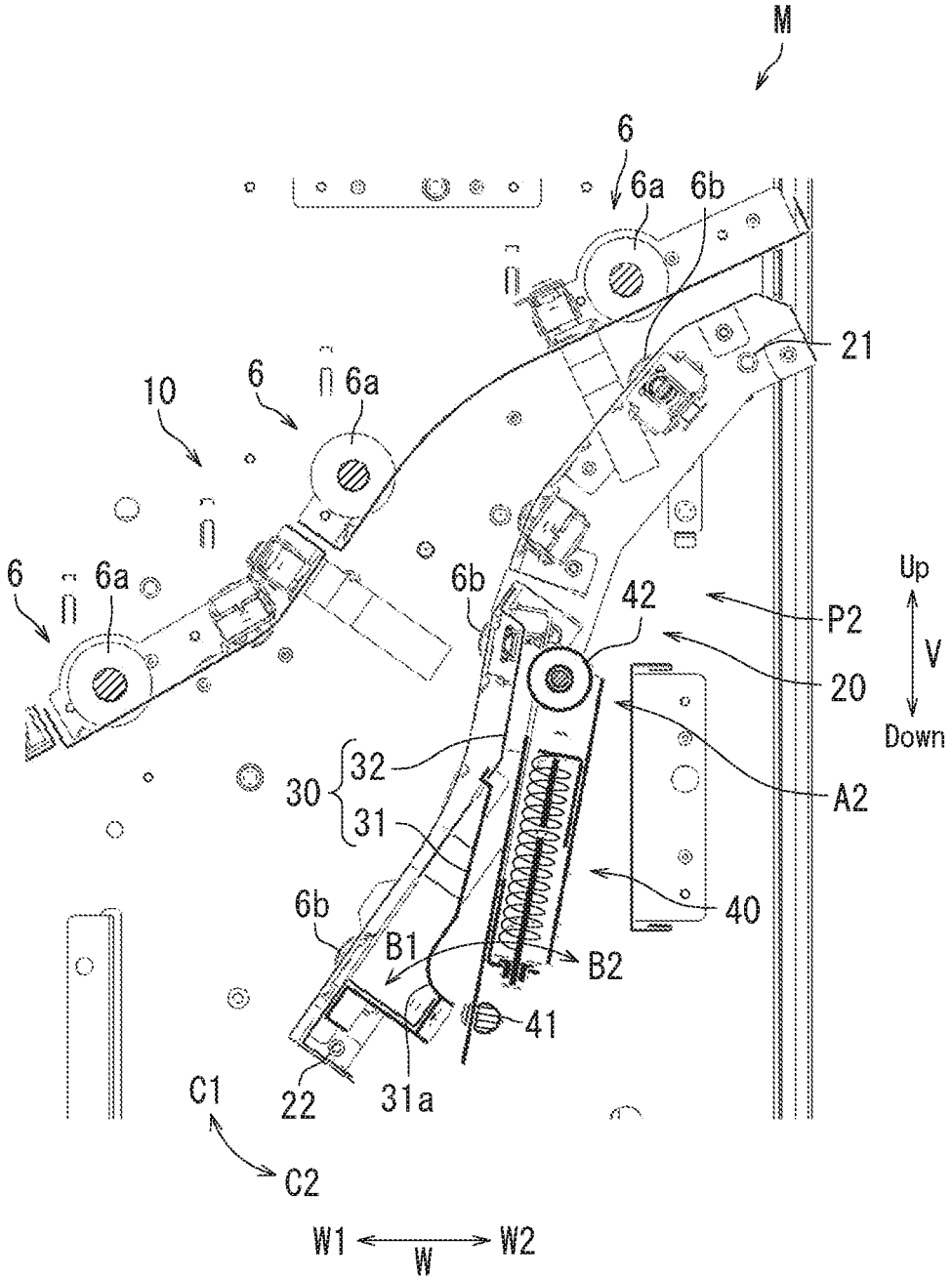
FIG. 5 is a schematic cross-sectional view illustrating the second guide section in a separation position.

The following describes the second guide section 20 with reference to FIGS. 4 and 5.

FIG. 4 illustrates the second guide section 20 in a guide position P1. The guide position P1 is a position of the second guide section 20 when the conveyance path R of the sheet T is formed between the second guide section 20 and the first guide section 10.

As illustrated in FIG. 4, when the second guide section 20 is in the guide position P1, the first guide section 10 and the second guide section 20 are opposed to each other to form the conveyance path R of the sheet T therebetween. When the second guide section 20 is in the guide position P1, the first rollers 6*a* are in contact with the corresponding second rollers 6*b* to form the nip parts N therebetween. Upon rotation of the first rollers 6*a* and the second rollers 6*b* while holding the sheet T at the nip parts N, the sheet T is conveyed along the conveyance path R.

When the second guide section 20 is in the guide position P1, the movable section 42 is in a first position A1. That is, the first position A1 is a position of the movable section 42 when the second guide section 20 is in the guide position P1. When the movable section 42 is in the first position A1, the movable section 42 is located upper than the arm center portion 41 in the vertical direction V and is located on the one side W1 in the horizontal direction W as seen from the arm center portion 41.

The rail section 30 further has a specific portion 31*a*. The specific portion 31*a* is a portion of the rail section 30 in contact with the movable section 42 when the second guide section 20 is in the guide position P1. The specific portion 31*a* is located at a lower end of the first rail 31 in the present embodiment.

The arm section 40 is pivotable in a first arm pivot direction B1 and a second arm pivot direction B2 about the arm center portion 41. The second arm pivot direction B2 is opposite to the first arm pivot direction B1.

When the arm section 40 pivots in the first arm pivot direction B1, the movable section 42 comes close to the specific portion 31*a*. Specifically, the first arm pivot direction B1 is a direction in which the arm section 40 pivots when the movable section 42 comes close to the specific portion 31*a* by moving toward the one side W1 in the horizontal direction W.

When the arm section 40 pivots in the second arm pivot direction B2, the movable section 42 moves away from the specific portion 31*a*. Specifically, the second arm pivot direction B2 is a direction in which the arm section 40 pivots when the movable section 42 moves away from the specific portion 31*a* by moving toward an opposite side W2 in the horizontal direction W.

The conveying device M further includes a restriction section 50. The restriction section 50 restricts movement of the movable section 42 to prevent the movable section 42 from moving downward in the vertical direction V farther than the first position A1. The restriction section 50 is included in the second guide section 20. The restriction section 50 pivots together with the second guide section 20. The restriction section 50 is connected to the rail section 30 in the present embodiment. Specifically, the restriction section 50 is connected to the first rail 31. The restriction section 50 is disposed such that when the movable section 42 is in the first position A1, the restriction section 50 is in contact with the movable section 42 from below in the vertical direction V.

When the movable section 42 is in the first position A1, the movable section 42 is in contact with the specific portion 31*a* of the rail section 30 as well as being in contact with the restriction section 50. Since the restriction section 50 is in contact with the movable section 42, the movable section 42 is kept in the first position A1. As a result, the second guide section 20 is kept in the guide position P1.

The restriction section 50 is connected to the specific portion 31*a* of the rail section 30. Note that the restriction section 50 may be separate from the rail section 30 rather than being connected to the rail section 30.

FIG. 5 illustrates the second guide section 20 in a separation position P2.

As illustrated in FIG. 5, when the second guide section 20 is in the separation position P2, the first rollers 6*a* are spaced from the corresponding second rollers 6*b*. The first rollers 6*a* and the second rollers 6*b* out of contact with one another do not form the nip parts N. In the present embodiment, when the second guide section 20 is in the separation position P2, the movable section 42 separates from the rail section 30 to be out of contact with the rail section 30. When the movable section 42 separates from the rail section 30, the elastic force of the urging section 43 does not act on the second guide section 20. As a result, when the second guide section 20 is in the separation position P2, the second guide section 20 moves by its own weight in a direction to hang down from the guide center portion 21. Note that the movable section 42 may be in contact with the rail section 30 when the second guide section 20 is in the separation position P2.

When the second guide section 20 is in the separation position P2, the movable section 42 is in a second position A2. That is, the second position A2 is a position of the movable section 42 when the second guide section 20 is in the separation position P2. When the movable section 42 is in the second position A2, the movable section 42 is located upper than the arm center portion 41 in the vertical direction V and is located on the opposite side W2 in the horizontal direction W as seen from the first position A1 (see FIG. 4). Note that the movable section 42 may be located on the one side W1 in the horizontal direction W as seen from the arm center portion 41 when the movable section 42 is in the second position A2. Alternatively, the movable section 42 may be located on the opposite side W2 in the horizontal direction W as seen from the arm center portion 41 when the movable section 42 is in the second position A2.

The conveying device M further includes a non-illustrated second stopper member. The second stopper member restricts pivoting of the arm section 40 to prevent the arm section 40 from further pivoting in the second arm pivot direction B2 from a state in which the movable section 42 is in the second position A2. The second stopper member is for example secured to the frame K and restricts pivoting of the arm section 40 while in contact with the arm section 40.

As illustrated in FIGS. 4 and 5, the second guide section 20 is pivotable between the guide position P1 and the separation position P2. The second guide section 20 is located in the separation position P2 as a result of pivoting from the guide position P1 about the guide center portion 21 by a specific angle. The specific angle is for example an angle that enables a user to perform maintenance of the conveyance path R.

When the second guide section 20 pivots by the specific angle, a space between the first guide section 10 and the second guide section 20 is enlarged. Therefore, the user is able to perform maintenance of the conveyance path R. Examples of maintenance of the conveyance path R include removal of a jammed sheet T from the conveyance path R.

In the present embodiment, when the second guide section 20 pivots from the guide position P1 toward the separation position P2, the pivotable end 22 of the second guide section 20 pivots about the guide center portion 21 downward in the vertical direction V.

The second guide section 20 is pivotable in a first pivot direction C1 and a second pivot direction C2. The first pivot direction C1 is a direction in which the second guide section 20 pivots from the separation position P2 toward the guide position P1. The second pivot direction C2 is opposite to the first pivot direction C1. Specifically, the second pivot direction C2 is a direction in which the second guide section 20 pivots from the guide position P1 toward the separation position P2.

The conveying device M further includes a non-illustrated first stopper member. The first stopper member restricts pivoting of the second guide section 20 to prevent the second guide section 20 from further pivoting in the second pivot direction C2 from the separation position P2. The first stopper member is for example secured to the frame K and restricts pivoting of the second guide section 20 while in contact with the second guide section 20. The specific angle is set through adjustment of a position of the first stopper member.

The following describes movement of the second guide section 20 with reference to FIGS. 4 and 5.

As illustrated in FIGS. 4 and 5, when the arm section 40 pivots in the second arm pivot direction B2, the movable section 42 moves away from the specific portion 31*a* along the rail section 30 and the second guide section 20 pivots in the second pivot direction C2. Accordingly, the second guide section 20 moves from the guide position P1 to the separation position P2 as a result of the arm section 40 pivoting in the second arm pivot direction B2.

When the arm section 40 pivots in the first arm pivot direction B1, the movable section 42 moves toward the specific portion 31*a* along the rail section 30 and the second guide section 20 pivots in the first pivot direction C1. Accordingly, the second guide section 20 moves from the separation position P2 to the guide position P1 as a result of the arm section 40 pivoting in the first arm pivot direction B1.

Figure 6:
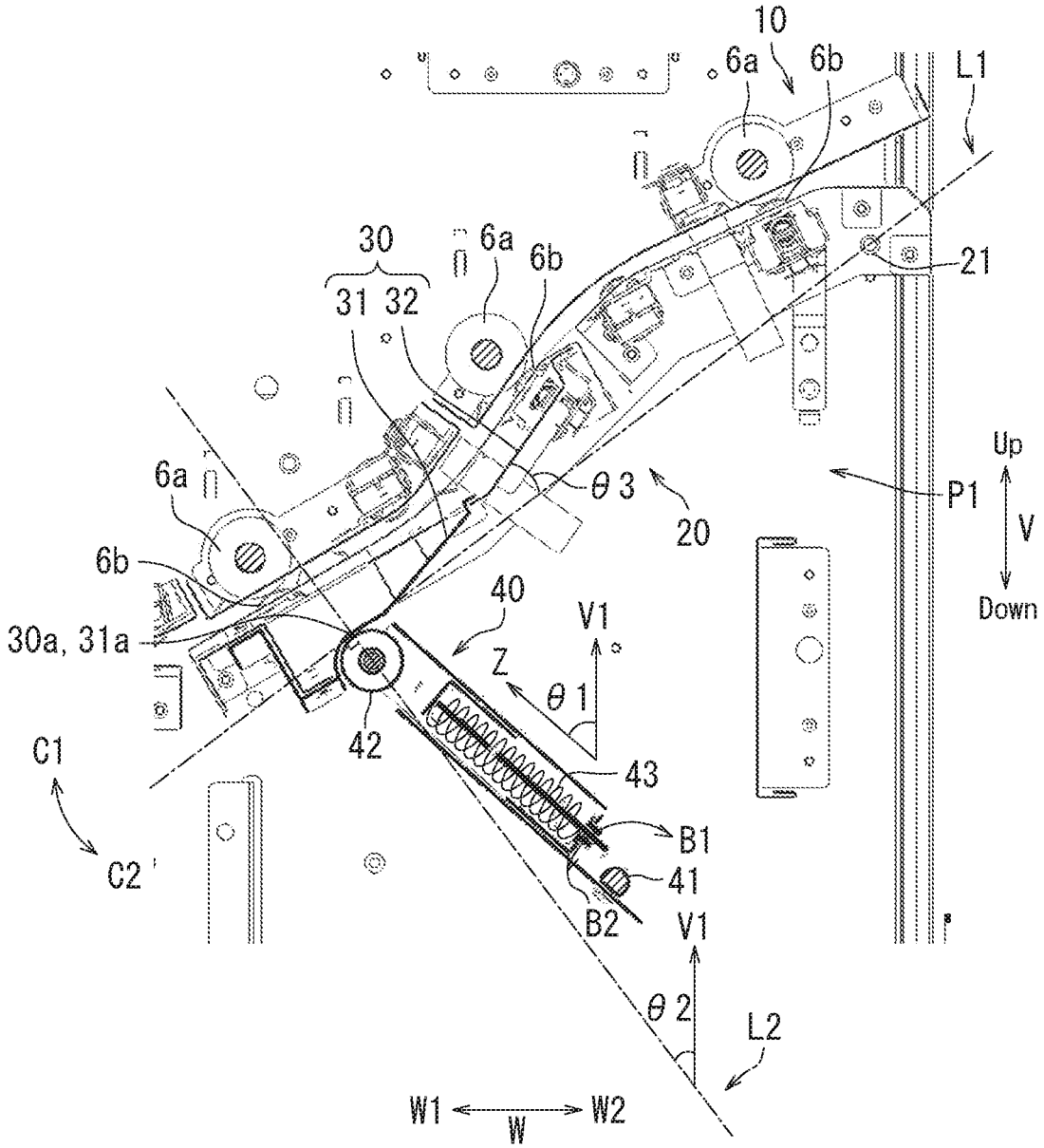
FIG. 6 is a schematic cross-sectional view illustrating an imaginary line and an imaginary normal line.

The following further describes the second guide section 20 in the guide position P1 with reference to FIG. 6.

FIG. 6 illustrates an imaginary line L1. The imaginary line L1 is an imaginary line passing through the guide center portion 21 and a contact portion 30*a*. The contact portion 30*a* is a portion of the rail section 30 in contact with the movable section 42.

FIG. 6 further illustrates an imaginary normal line L2. The imaginary normal line L2 is an imaginary line intersecting at right angles with the imaginary line L1 and passing through the contact portion 30*a*.

When the second guide section 20 is in the guide position P1, the movable section 42 is in contact with the specific portion 31*a*. Accordingly, the contact portion 30*a* is the specific portion 31*a* when the second guide section 20 is in the guide position P1. That is, the imaginary line L1 passes through the guide center portion 21 and the specific portion 31*a* when the second guide section 20 is in the guide position P1. Also, the imaginary normal line L2 intersects at right angles with the imaginary line L1 and passes through the specific portion 31*a* when the second guide section 20 is in the guide position P1.

FIG. 6 further illustrates a first inclination angle θ1. The first inclination angle θ1 indicates an angle of inclination of the separation direction Z relative to an upward vertical direction V1. FIG. 6 further illustrates a second inclination angle θ2. The second inclination angle θ2 indicates an angle of inclination of the imaginary normal line L2 relative to the upward vertical direction V1. The first inclination angle θ1 and the second inclination angle θ2 are acute angles in the present embodiment.

When the second guide section 20 is in the guide position P1, the arm center portion 41 is located upper than the imaginary normal line L2 in the vertical direction V. In this state, the elastic force of the urging section 43 in the separation direction Z acts in the first pivot direction C1. Therefore, the urging section 43 urges the second guide section 20 in the first pivot direction C1 when the second guide section 20 is in the guide position P1.

The second guide section 20 can be kept in the guide position P1 by the urging section 43 urging the second guide section 20 in the first pivot direction C1. Therefore, the second guide section 20 can be prevented from moving inadvertently from the guide position P1.

The second guide section 20 can be kept in the guide position P1 by the urging section 43 urging the second guide section 20 in the first pivot direction C1.

The urging section 43 urges the second guide section 20 in the first pivot direction C1 with the elastic force of specific strength when the second guide section 20 is in the guide position P1. The specific strength of the elastic force is for example equivalent to or greater than a sum of the weight of the second guide section 20 and a pressure acting at the nip parts N. The pressure acting at the nip parts N is specifically a pressure that the second rollers 6*b* receive from the corresponding first rollers 6*a* at the respective nip parts N.

When the second guide section 20 is in the guide position P1, an inclination angle θ3 of the rail section 30 relative to the imaginary line L1 is greater than 0° and no greater than 30°. In this configuration, a force needed to be applied to the arm section 40 to cause the second guide section 20 to pivot through pivoting of the arm section 40 can be reduced and the arm section 40 can smoothly pivot.

The following describes movement of respective elements of the conveying device M when the second guide section 20 pivots from the guide position P1 to the separation position P2 with reference to FIG. 6. The respective elements of the conveying device M move in the following sequence (i) to (iv).

(i) When the second guide section 20 is in the guide position P1, a difference between the first inclination angle θ1 and the second inclination angle θ2 is a positive value ($\theta 1-\theta 2>0$). When the difference between the first inclination angle θ1 and the second inclination angle θ2 is a positive value, the arm center portion 41 is located upper than the imaginary normal line L2 in the vertical direction V. When the arm center portion 41 is located upper than the imaginary normal line L2 in the vertical direction V, the elastic force of the urging section 43 in the separation direction Z acts in the first pivot direction C1. Accordingly, when the arm center portion 41 is located upper than the imaginary normal line L2 in the vertical direction V, the urging section 43 urges the second guide section 20 in the first pivot direction C1. Specifically, when the arm center portion 41 is located upper than the imaginary normal line L2 in the vertical direction V while the movable section 42 is located on the rail section 30, the urging section 43 urges the second guide section 20 in the first pivot direction C1.

(ii) As the second guide section 20 pivots in the second pivot direction C2 from a position where the difference between the first inclination angle θ1 and the second inclination angle θ2 is a positive value, the difference decreases and becomes 0 (θ1−θ2=0). When the difference between the first inclination angle θ1 and the second inclination angle θ2 is 0, the arm center portion 41 is located on the imaginary normal line L2. When the arm center portion 41 is located on the imaginary normal line L2, the separation direction Z is parallel to the imaginary normal line L2. Accordingly, the elastic force of the urging section 43 in the separation direction Z acts neither in the first pivot direction C1 nor in the second pivot direction C2. Therefore, when the arm center portion 41 is located on the imaginary normal line L2, the urging section 43 urges the second guide section 20 neither in the first pivot direction C1 nor in the second pivot direction C2.

(iii) When the second guide section 20 further pivots in the second pivot direction C2 from a position where the difference between the first inclination angle θ1 and the second inclination angle θ2 is 0, the difference becomes a negative value (θ1−θ2<0). When the difference between the first inclination angle θ1 and the second inclination angle θ2 is a negative value, the arm center portion 41 is located lower than the imaginary normal line L2 in the vertical direction V. When the arm center portion 41 is located lower than the imaginary normal line L2 in the vertical direction V, the elastic force of the urging section 43 in the separation direction Z acts in the second pivot direction C2. Accordingly, when the arm center portion 41 is located lower than the imaginary normal line L2 in the vertical direction V, the urging section 43 urges the second guide section 20 in the second pivot direction C2. Specifically, when the arm center portion 41 is located lower than the imaginary normal line L2 in the vertical direction V while the movable section 42 is located on the rail section 30, the urging section 43 urges the second guide section 20 in the second pivot direction C2.

(iv) As the second guide section 20 further pivots in the second pivot direction C2 from a position where the difference between the first inclination angle θ1 and the second inclination angle θ2 is a negative value, the movable section 42 separates from the rail section 30. The second guide section 20 then reaches the separation position P2.

As described above in (i) to (iv), in the course of the second guide section 20 pivoting from the guide position P1 to the separation position P2, an urging direction changes from the first pivot direction C1 to the second pivot direction C2. Therefore, the second guide section 20 can be caused to smoothly pivot toward the separation position P2. The urging direction is a direction in which the urging section 43 urges the second guide section 20.

Note that the respective elements of the conveying device M move in sequence opposite to the above sequence (i) to (iv) when the second guide section 20 pivots from the separation position P2 to the guide position P1. Accordingly, in the course of the second guide section 20 pivoting from the separation position P2 to the guide position P1, the urging direction changes from the second pivot direction C2 to the first pivot direction C1. As a result, the second guide section 20 can be caused to smoothly pivot toward the guide position P1.

When a user operates the arm section 40 to cause the second guide section 20 to pivot, the user can feel clicking sensation due to a change in the urging direction through the operation on the arm section 40. Therefore, the user can recognize a position of the second guide section 20 on the basis of the clicking sensation.

Through the above, the embodiment of the present disclosure has been described with reference to the drawings (FIGS. 1 to 6). However, the present disclosure is not limited to the above embodiment, and can be practiced in various forms within a scope not departing from the gist of the present disclosure (for example, as described below in (1) and (2)). Also, elements of configuration described in the above embodiment may be combined as appropriate to give various alterations of the present disclosure. For example, some elements of configuration may be omitted from the elements of configuration described in the above embodiment. The drawings schematically illustrate elements of configuration to facilitate understanding. The number or the like of each element of configuration illustrated in the drawings may differ from actual one thereof to facilitate preparation of the drawings. Also, the elements of configuration described in the above embodiment are merely examples and should not be taken to limit the present disclosure. Various alterations can be made within a scope not substantially departing from the effects of the present disclosure.

(1) The image forming section 5 forms a monochrome toner image on the sheet T in the above embodiment. However, the present disclosure is not limited as such. The image forming section 5 may form a non-black toner image on the sheet T with a plurality of toners in different colors. In this case, the image forming section 5 may be a tandem apparatus including a plurality of photosensitive drums or a rotary apparatus including a single photosensitive drum. The image forming section 5 may have nozzles and form an image on the sheet T by ejecting ink from the nozzles. In this case, the image is an ink image.

(2) The conveying device M is located opposite to a side surface of the image forming apparatus 100 in the above embodiment. However, the present disclosure is not limited as such. The conveying device M may be located inside of the image forming apparatus 100. The conveying device M may be provided either or both in a sheet conveyance path leading to the image forming section 5 and in a sheet conveyance path leading to the reader 3. The conveying device M may be provided in a sheet feeder. The sheet feeder is connected to the image forming apparatus 100 and feeds a sheet to the image forming section 5. The conveying device M may be provided either or both at a location upstream of the reader 3 in the conveyance direction of the sheet and at a location downstream of the reader 3 in the conveyance direction of the sheet.

What is claimed is:

1. A conveying device that conveys a sheet, the conveying device comprising:

a first guide section extending in a conveyance direction of the sheet;

a second guide section having a fulcrum portion and configured to pivot about the fulcrum portion; and an urging section configured to urge the second guide section, wherein the second guide section is pivotable between a guide position and a separation position, the guide position being a position in which the second guide section is located when a conveyance path of the sheet is formed between the second guide section and the first guide section, the separation position being a position in which the second guide position is located as a result of pivoting from the guide position by a specific angle, when the second guide section is in the guide position, the urging section urges the second guide section in a first pivot direction, the first pivot direction being a direction in which the second guide section pivots from the separation position toward the guide position, and in a course of the second guide section pivoting from the guide position to the separation position, a direction in which the urging section urges the second guide section changes from the first pivot direction to a second pivot direction, the second pivot direction being a direction in which the second guide section moves from the guide position to the separation position.

2. The conveying device according to claim 1, further comprising:

a rail section provided along the second guide section; and a pivotably supported arm section, wherein the arm section includes:

the urging section;

an arm fulcrum portion about which the arm section pivots; and a movable section movable on the rail section, and the urging section is located between the arm fulcrum portion and the movable section.

3. The conveying device according to claim 2, wherein when the movable section is located on the rail section, the urging section urges the movable section in a separation direction, the separation direction being a direction in which the movable section moves away from the arm fulcrum portion.

4. The conveying device according to claim 2, wherein the rail section has a specific portion that is in contact with the movable section when the second guide section is in the guide position, and the arm section is pivotable in a first arm pivot direction and a second arm pivot direction, the first arm pivot direction being a direction in which the arm section pivots to cause the movable section to come close to the specific portion, the second arm pivot direction being a direction in which the arm section pivots to cause the movable section to move away from the specific portion.

5. The conveying device according to claim 4, wherein when the arm section pivots in the first arm pivot direction, the movable section moves toward the specific portion along the rail section and the second guide section pivots in the first pivot direction, and when the arm section pivots in the second arm pivot direction, the movable section moves away from the specific portion along the rail section and the second guide section pivots in a second pivot direction opposite to the first pivot direction.

6. The conveying device according to claim 4, wherein the second guide section is located lower than the first guide section in a vertical direction, the arm fulcrum portion is located lower than the fulcrum portion in the vertical direction and is located on one side in a horizontal direction as seen from the guide fulcrum portion, when the second guide section is in the guide position, the movable section is in a first position, the first position being located upper than the arm fulcrum portion in the vertical direction and being located on a side opposite to the fulcrum portion in the horizontal direction as seen from the arm fulcrum portion, and when the second guide section is in the separation position, the movable section is in a second position, the second position being located upper than the arm fulcrum portion in the vertical direction and being located on the fulcrum side in the horizontal direction as seen from the first position.

7. The conveying device according to claim 6, further comprising a restriction section configured to restrict movement of the movable section to prevent the movable section from moving downward in the vertical direction farther than the first position.

8. The conveying device according to claim 6, wherein when the second guide section is in the guide position, the arm fulcrum portion is located upper than an imaginary normal line in the vertical direction, the imaginary normal line being a line intersecting at right angles with an imaginary line and passing through a contact portion, the imaginary line being a line passing through the fulcrum portion and the contact portion, the contact portion being a portion of the rail section in contact with the movable section.

9. The conveying device according to claim 8, wherein when the second guide section is in the guide position, an angle of inclination of the rail section relative to the imaginary line is greater than 0° and no greater than 30°.

10. An image forming apparatus comprising the conveying device according to claim 1.

* * * * *